US005880619A

United States Patent [19]

Barrett, Jr. et al.

[11] Patent Number: 5,880,619

[45] Date of Patent: Mar. 9, 1999

[54] LOW POWER PRECISION VOLTAGE SPLITTER

[75] Inventors: Raymond Louis Barrett, Jr., Ft. Lauderdale; Barry W. Herold; Grazyna A. Pajunen, both of Delray Beach, all of Fla.

[73] Assignee: Motorola, Inc., Schaumburg, Ill.

[21] Appl. No.: 990,548

[22] Filed: Dec. 15, 1997

[51] Int. Cl.[6] ..... G05F 1/10; G05F 3/316

[52] U.S. Cl. ..... 327/532; 327/542; 327/543; 323/313

[58] Field of Search ..... 327/530, 531, 327/532, 538, 540, 541, 542, 543; 323/313; 363/62

[56] References Cited

U.S. PATENT DOCUMENTS

| | | | |
|---|---|---|---|
| 5,047,727 | 9/1991 | Theus | 327/65 |
| 5,111,154 | 5/1992 | Nakagawara | 330/85 |
| 5,789,973 | 8/1998 | Barrett, Jr. et al. | 327/561 |

*Primary Examiner*—Timothy P. Callahan
*Assistant Examiner*—Terry L. Englund
*Attorney, Agent, or Firm*—James A. Lamb

[57] ABSTRACT

A voltage splitter circuit (100) that generates a one-half supply voltage includes a first switched operational transconductance amplifier (switched OTA) (120), a first transistor switch (110) that is controlled by a first clock signal (108) to periodically switch a first supply voltage (135) to a non-inverting input (118) of the first switched OTA, a second switched OTA (115), a second transistor switch (105) that is controlled by an inverted second clock signal (104) to periodically switch a second supply voltage (130) to a non-inverting input (114) of the second switched OTA, a commutating capacitor (112) coupled between the non-inverting input of the first switched OTA and the non-inverting input of the second switched OTA, a first filter capacitor (145) coupled to an output (121) of the first switched OTA, a second filter capacitor (140) coupled to an output (116) of the second switched OTA, and a third switched OTA (125). The first and second clock signals are non-overlapping.

7 Claims, 2 Drawing Sheets

LOW POWER PRECISION VOLTAGE SPLITTER

FIELD OF THE INVENTION

This invention relates in general to voltage references for integrated circuits and in particular to one-half voltage references for integrated circuits incorporating analog computation elements.

BACKGROUND OF THE INVENTION

Power requirements and size are critical design parameters in portable electronic devices such as pagers and broadcast frequency modulation (FM) radio receivers. In an increasingly energy conscious world, these two design parameters are also important in other electronic devices that operate when plugged into an alternating current (AC) supply.

A circuit that is often used within integrated circuits in such devices is a one-half supply voltage reference, also described herein as a voltage splitter. Such a circuit is particularly useful when a signal is needed in an analog circuit that must represent both positive and negative polarities, when the analog circuit has only one power supply. When a reference voltage level of one-half of the power supply voltage is established, positive deviations from the reference level can be used to represent positive polarities and negative deviations can be used to represent negative polarities. Equivalent maximum deviations for both positive and negative polarity signals are conveniently allowed when the reference voltage level is established as near to one-half the power supply voltage as is practicable. The reference voltage must be capable of supplying some amount of current (which is usually relatively small), and must be relatively noise free. One technique for supplying such a reference voltage is to use a well known resistor divider with two equal resistors. The precision of the resistor divider is directly related to the precision of the resistors, and the output impedance of the resistor divider is directly related to the value of the resistances used. However, for a resistor divider having an output impedance of, for example, 2.5 MegOhms, the area of the 5 MegOhm divider resistors, even when they are implemented having the smallest practical surface area, is very large in comparison to transistors and capacitors in modern integrated circuits, and the tolerance of the ratio of the divider is on the order of a few percent.

Thus, what is needed is a voltage splitter circuit that is small and requires little power to operate.

DETAILED DESCRIPTION OF THE PREFERRED EMBODIMENT

Figure 1:
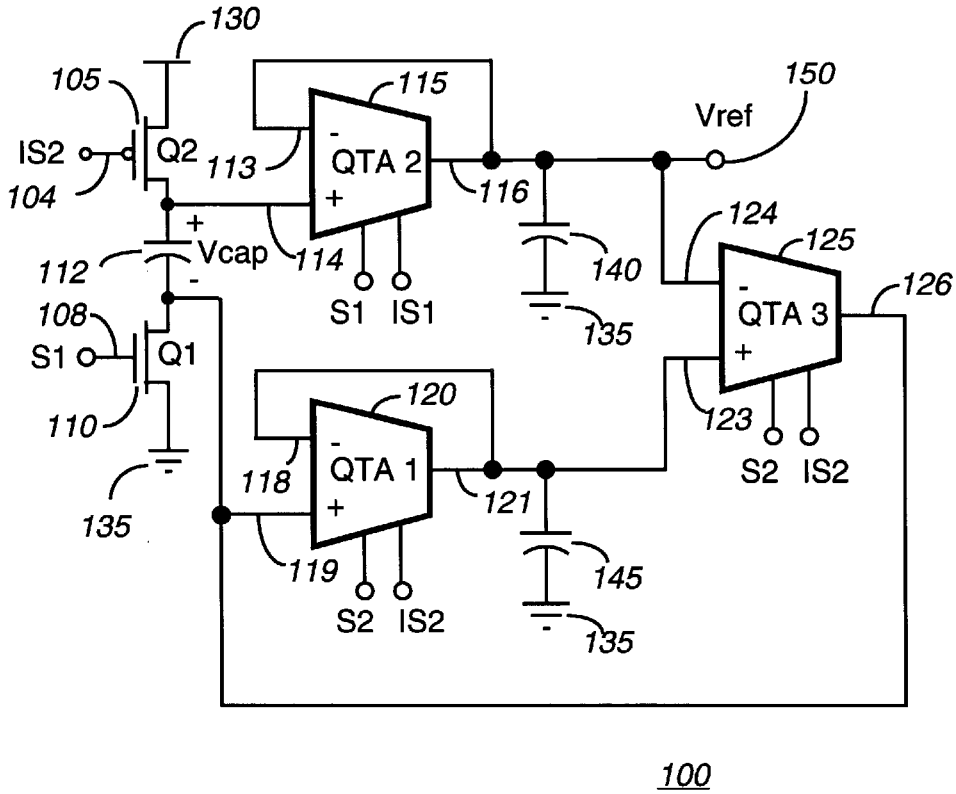
FIG. 1 is an electrical block diagram of a voltage splitter circuit, in accordance with the preferred embodiment of the present invention.

Referring to FIG. 1, a voltage splitter circuit 100 is shown that generates a one-half supply reference voltage (Vref) at a reference output 150, in accordance with the preferred embodiment of the present invention. The voltage splitter circuit 100 comprises conventional integrated circuit components in a unique configuration, driven by conventional clock signals having a specific relationship. The voltage splitter circuit 100 comprises a first switched operational transconductance amplifier (OTA) 120 (shown as OTA 1 in FIG. 1); a first transistor switch 110 (Q1) that is controlled by a first clock signal (S1) 108 to periodically switch a first supply voltage 135 to a non-inverting input 119 of the first switched OTA 120; a second switched OTA 115 (shown as OTA 2 in FIG. 1); a second transistor switch 105 (Q2) that is controlled by an inverted second clock signal (IS2) 104 to switch a second supply voltage 130 to a non-inverting input 114 of the second switched OTA 115; and a commutating capacitor 112 coupled between the non-inverting input 114 of the second switched OTA 115 and the non-inverting input 119 of the first switched OTA 120. The voltage splitter circuit 100 further comprises a first filter capacitor 145 coupled between an output 121 of the first switched OTA 120 and the first supply voltage 135; a second filter capacitor 140 coupled between an output 116 of the second switched OTA 115 and the first supply voltage 135; and a third switched OTA 125 (shown as OTA 3 in FIG. 1).

Figure 2:
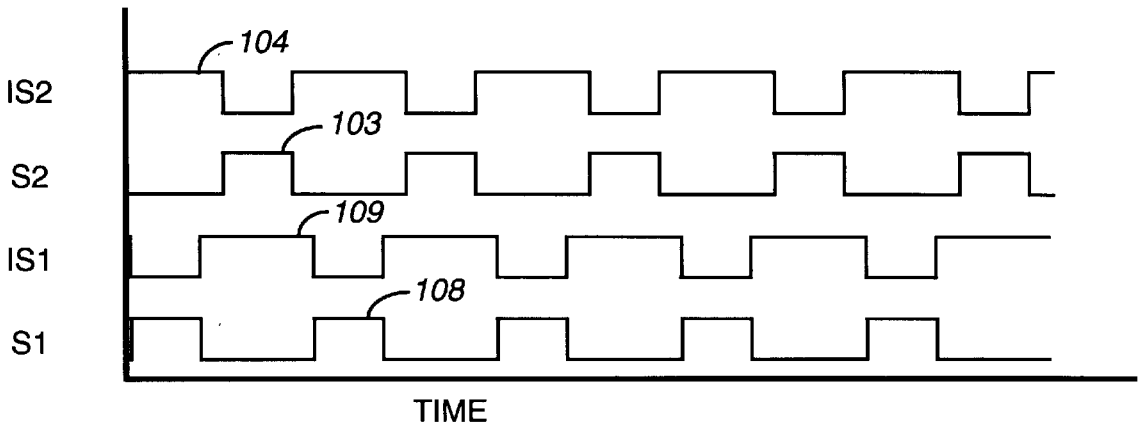
FIG. 2 is a waveform diagram which illustrates features of clock signals used to drive the voltage splitter circuit shown in FIG. 1, in accordance with the preferred embodiments of the present invention.

In the voltage splitter circuit 100, the output 116 of the second switched OTA 115 is coupled to the inverting input 113 of the second switched OTA 115 and to a non-inverting input 124 of the third switched OTA 125. The output 121 of the first switched OTA 120 is coupled to an inverting input 118 of the first switched OTA 120 and to an inverting input 123 of the third switched OTA 125. An output 126 of the third switched OTA 125 is coupled to the non-inverting input 119 of the first switched OTA 120. The voltage at the reference output 150, Vref, is the same as the voltage at the output 116 of the second switched OTA 115. The first, second, and third switched OTAs 120, 115, 125 are expressly designed to be switched on and off by clock signals, as shown in FIG. 2, and therefore are referred to as switched OTAs in accordance with the present invention. The second switched OTA 115 is repetitively switched on and off by the first clock signal (S1) 108 and its complement, an inverted first clock signal (IS1) 109. The first and third switched OTAs 120, 125 are each repetitively switched on and off by a second clock signal (S2) 103 and its complement, the inverted second clock signal (IS2) 104.

In accordance with the preferred embodiment of the present invention, Q1 110 and Q2 105 are metal oxide semiconductor field effect transistors (MOSFETs), with Q2 105 being a P channel MOSFET and Q1 110 being an N channel MOSFET. The commutating capacitor 112 and the two filter capacitors 140, 145 are conventional thin film capacitors (preferably they are gate capacitances), and the switched OTAs 115, 120, 125 are of conventional current mirror design. The first and second supply voltages are preferably provided by negative and positive terminals, respectively of a battery, but alternatively could be negative and positive voltages provided by a power supply such as an alternating current (AC) to direct current (DC) converter. The transconductances of the first switched OTA 120 and the second switched OTA 115 are preferably approximately equal, as are the values of the first and second filter capacitors 140, 145.

Referring to FIG. 2, a waveform diagram which illustrates features of clock signals used to drive the voltage splitter circuit 100 is shown, in accordance with the preferred embodiment of the present invention. The specific relationship required of the first and second clock signals S1 108 and S2 103 is that they are non-overlapping; that is, S1 108 and S2 103 are never both in the active (high) state at the same time.

It will be appreciated that S1 108 activates Q1 110 and the second switched OTA 115 during those intervals in which S1 108 is asserted and deactivates Q1 110 and the second switched OTA 115 when S1 is unasserted, and that IS2 104 activates Q2 105 and the first and third switched OTAs 120, 125 during those intervals in which S2 103 is asserted (IS2 104 is negative during those times S2 103 is asserted, activating the gate of Q2 105 and turning it on), and deactivates Q2 105 and the first and third switched OTAs 120, 125 when S2 is unasserted. The non-overlapping clock behavior ensures that a current path never exists through a series connection of Q2 105, Q1 110, and commutating capacitor 112 due to Q1 110 and Q2 105 never being simultaneously active. When deactivated, the outputs of the switched OTAs 120, 115, 125 are in a high impedance state. As a consequence, the voltages across the capacitors 140, 145 do not change while the respective switched OTAs 115, 120 are de-activated (off).

The commutating capacitor 112 stores a charge and develops a positive voltage designated as Vcap with a polarity as shown in FIG. 1. The value of Vcap is constrained by circuit operation to be between zero and a net supply voltage, which is the second supply voltage 130 minus the first supply voltage 135. The initial value of Vcap is arbitrary, being charged by leakage through Q2 105 and Q1 110, and depletion regions of the commutating capacitor 112 to a value within the net supply voltage range. The commutating capacitor thus has a negative terminal coupled to Q1 110 and a positive terminal coupled to Q2 105.

The sequence of operation is described by beginning with the activation of S1 108, which activates both Q1 110 and the second switched OTA 115 simultaneously. The activation of Q1 110 causes the negative terminal of the commutating capacitor 112 to be connected to the first supply voltage 135, and presents the positive value of Vcap to the non-inverting input of the second switched OTA 115. The topology including the second filter capacitor 140 connected to both the output 116 and the inverting input 113 of the second switched OTA 115 configures the second switched OTA 115 to perform as a first low-pass filter that is a first-order discrete-time time-division multiplexed low-pass filter. A −3 dB frequency of this first low-pass filter is defined by the ratio of a transconductance of the second switched OTA 115 to the value of the second filter capacitor 140, reduced by multiplication by the duty cycle of S1 108. Since the value of Vcap is presented to the first low-pass filter in a sampled form under the control of S1 108, there is little advantage in making the −3 dB frequency any higher than a Nyquist rate established by the sampling rate established by S1 108. Preferably, the −3 dB frequency is designed somewhat lower to remove any noises introduced by switching transients. Too low a −3 dB frequency makes the voltage splitter circuit 100 slow in arriving at a steady state value for Vref equal to the average value of Vcap at the reference output 150, negatively impacting start-up times.

The first switched OTA 120 and the first filter capacitor 145 operate under the control of S2 103 as a second first-order discrete-time time-division multiplexed low-pass filter, in a similar fashion to the operation of the second switched OTA 115 and the second filter capacitor 140 under the control of S1 108, but with a major difference that the signal presented at the non-inverting input 119 to the first switched OTA 120 (which is an input to this second low-pass filter) arrives when Q2 105 is active, connecting the positive terminal of the commutating capacitor 112 to the second supply voltage 130, and making the negative terminal of the commutating capacitor 112 equal to the value of the net supply voltage minus Vcap, and hence the output of the second low-pass filter approaches the average value of the net supply voltage minus Vcap as a steady state value.

The third switched OTA 125 also operates as a discrete-time time-division multiplexed lowpass filter, but in conjunction with the first order filters defined by the first switched OTA 120, the first filter capacitor 145, and S2 103, the integration that is provided by the third switched OTA 125, operating together with the second filter capacitor 140, raises the order to a second order filter for the signal Vref 150 that is coupled to the non-inverting input 124 of the third switched OTA 125 (which is described above as having a steady state value equal to Vcap). The voltage across the second filter capacitor 140 is filtered by an all-pole second order lowpass filter, driving the steady state value of the voltage to the average value of the full supply value minus Vcap. The output 126 of the third switched OTA 125 is filtered by a second-order lowpass function having a real zero, likewise driving the steady state value of the voltage at the output 126 to the average value of the net supply voltage minus Vcap.

The combined multiplexed feedback is negative, stable, and results in convergence to an equality of Vcap and the net supply voltage minus Vcap. Algebraic solution for Vcap in this equality results in a steady state value of Vcap that is one-half the net supply voltage. The solution is exact within the uncertainty provided by the offsets of the switched OTAs 115, 120, 125, and charge leakages, but is within a few millivolts of exactly half of the net supply voltage, representing an accuracy equivalent to a few tenths of a percent of the division ratio of exactly one-half. The voltage splitter circuit 100, while operating from a clock of a few tens of kiloHertz consumes less than 100 nanoAmperes including the non-overlapping clock generation, making the total current drain equivalent to the series connection of two very precise 5 MegOhm resistors that could alternatively be used, as in prior art circuits, to provide the voltage splitter function. The IC area consumed by the voltage splitter circuit 100 is more than a thousand times smaller than the area consumed by two 5 MegOhm resistors at the smallest dimensions they can be fabricated, which implies the resistors have tolerances of a few tens of percent and a ratio tolerance of a few percent.

Figure 3:
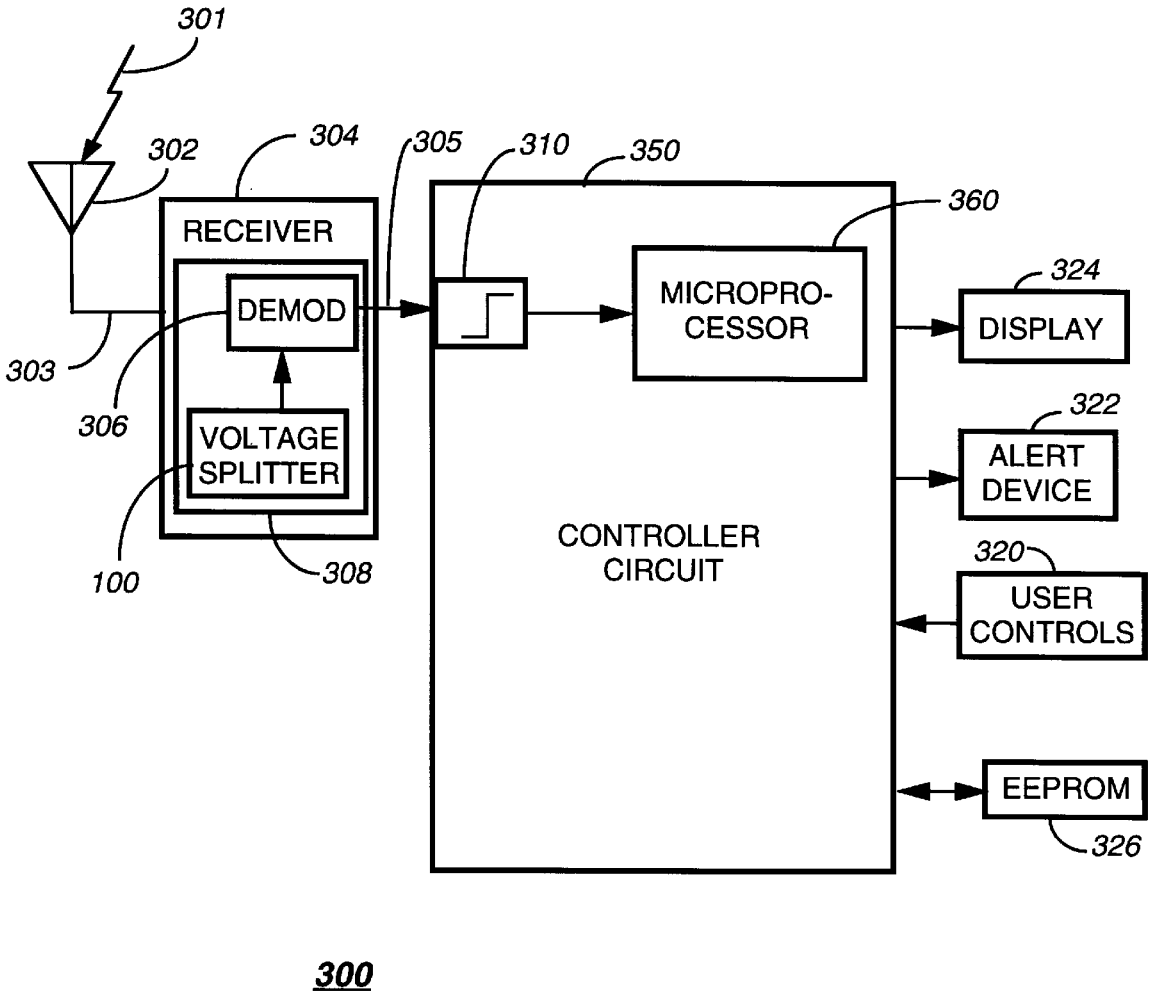
FIG. 3 is an electrical block diagram of a selective call radio, in accordance with the preferred embodiment of the present invention.

Referring to FIG. 3, an electrical block diagram of a radio 300 is shown, in accordance with the preferred embodiment of the present invention. The radio 300 is a selective call radio that includes an antenna 302 for intercepting a radiated signal 301. The antenna 302 converts the radiated signal 301 to a conducted radio signal 303 that is coupled to a receiver 304 wherein the conducted radio signal 303 is received. The receiver 304 comprises a demodulator 306 and the unique voltage splitter circuit 100. The demodulator 306 and the unique voltage splitter circuit 100 are implemented in a single integrated circuit 308 which includes most of the functions of the receiver 304. Using the one-half supply voltage reference Vref 150 generated by the unique voltage splitter circuit 100, the demodulator generates a demodulated signal 305 that is coupled to a controller circuit 350. The controller circuit 350 is coupled to a display 324, an alert 322, a set of user controls 320, and an electrically erasable read only memory (EEPROM) 326. The controller circuit 350 comprises a signal squaring circuit 310 and a microprocessor 360. The demodulated signal 305 is coupled to the signal squaring circuit 310 wherein it is converted to a binary signal that is coupled to the microprocessor 360. The microprocessor 360 is coupled to the EEPROM 326 for storing an embedded address stored therein during a maintenance operation and for loading the embedded address during normal operations of the radio 300. The microprocessor 360 is a conventional microprocessor comprising a central processing unit (CPU), a read only memory (ROM), and a random access memory (RAM).

A message processor function of the microprocessor 360 decodes outbound words and processes an outbound message when an address received in the address field of the outbound signaling protocol matches the embedded address stored in the EEPROM 326, in a manner well known to one of ordinary skill in the art for a selective call radio. An outbound message that has been determined to be for the radio 300 by the address matching is processed by the message processor function according to the contents of the outbound message and according to modes set by manipulation of the set of user controls 320, in a conventional manner. An alert signal is typically generated when an outbound message includes user information. The alert signal is coupled to the alert device 322, which is typically either an audible or a silent alerting device.

When the outbound message includes alphanumeric or graphic information, the information is displayed on the display 324 in a conventional manner by a display function at a time determined by manipulation of the set of user controls 320. All the parts of the radio 300 are conventional but for the voltage splitter circuit 100 in the receiver 304.

While the voltage splitter has been described above as being used in conjunction with a radio receiver demodulator, it will be appreciated that it is equally beneficial for use in many other applications, such as a reference voltage for a magnetic disk drive head circuit or a compact disk read only memory (CD-ROM) optical head circuit.

By now it should be appreciated that there has been provided a voltage splitter circuit 100 which provides a one-half supply voltage reference that has an integrated circuit area that is much smaller than the area used by prior art voltage splitter circuits, while providing a more precise voltage reference while requiring less power to operate.

We claim:

1. A voltage splitter circuit that generates a one-half supply voltage at a reference output, comprising:

a first switched operational transconductance amplifier (OTA);

a first transistor switch that is controlled by a first clock signal to periodically switch a first supply voltage to a non-inverting input of the first switched OTA;

a second switched OTA;

a second transistor switch that is controlled by an inverted second clock signal to periodically switch a second supply voltage to a non-inverting input of the second switched OTA;

a commutating capacitor coupled between the non-inverting input of the first switched OTA and the non-inverting input of the second switched OTA;

a first filter capacitor coupled between an output of the first switched OTA and the first supply voltage;

a second filter capacitor coupled between an output of the second switched OTA and the first supply voltage; and a third switched OTA, wherein the output of the second switched OTA is coupled to an inverting input of the second switched OTA and to a non-inverting input of the third switched OTA, and wherein the output of the first switched OTA is coupled to an inverting input of the first switched OTA and to an inverting input of the third switched OTA, and wherein an output of the third switched OTA is coupled to the non-inverting input of the first switched OTA, and wherein the reference output is the output of the second switched OTA, and wherein the second switched OTA is controlled by the first clock signal and an inverted first clock signal, and wherein the first and third switched OTAs are controlled by a second clock signal and the inverted second clock signal, and wherein the first and second clock signals are non-overlapping.

2. The voltage splitter circuit according to claim 1, wherein the first clock signal has a first duty cycle less than 50% and the second clock signal has a second duty cycle approximately equal to the first duty cycle.

3. The voltage splitter circuit according to claim 1, wherein the first transistor switch is an N channel metal oxide semiconductor field effect transistor (MOSFET) and the second transistor is a P channel MOSFET.

4. The voltage splitter circuit according to claim 1, wherein the first switched OTA and second switched OTA have transconductances that are approximately equal to each other, and wherein the first and second filter capacitors have approximately equal capacitance values.

5. The voltage splitter circuit according to claim 1, wherein the first supply voltage is negative with respect to the second supply voltage.

6. A radio that comprises at least one voltage splitter circuit according to claim 1.

7. An integrated circuit that comprises at least one voltage splitter circuit according to claim 1.

* * * * *